US007017455B2

(12) United States Patent
Hsien

(10) Patent No.: US 7,017,455 B2
(45) Date of Patent: Mar. 28, 2006

(54) HANDLE OF A HAND TOOL

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 57 days.

(21) Appl. No.: 10/797,193

(22) Filed: Mar. 11, 2004

(65) Prior Publication Data

US 2005/0199107 A1 Sep. 15, 2005

(51) Int. Cl.
*B25B 23/16* (2006.01)

(52) U.S. Cl. ..... 81/177.1; 81/177.9; 81/177.8

(58) Field of Classification Search ..... 81/177.1, 81/177.7, 177.8, 177.9, 177.75, 119, 125
See application file for complete search history.

(56) References Cited

U.S. PATENT DOCUMENTS 1,428,805 A * 9/1922 Reynolds et al. ..... 81/177.9
1,793,714 A * 2/1931 Newberg ..... 81/125.1
5,172,614 A * 12/1992 Monnet et al. ..... 81/119
D434,292 S * 11/2000 Hsieh ..... D8/28
6,186,034 B1 * 2/2001 Lamons ..... 81/177.9
6,336,383 B1 * 1/2002 Hung ..... 81/60

* cited by examiner

*Primary Examiner*—Lee D. Wilson
*Assistant Examiner*—Anthony Ojini

(57) ABSTRACT

A handle of a hand tool includes two opposite wide surfaces and two opposite narrow sides. The wide surfaces are perpendicular to the rotational direction when using the tool so that the fingers except for the thumb are in contact with the wide surfaces. Each wide surface has a reinforcement protrusion extending perpendicularly therefrom and located close to the driving end of the hand tool. Each reinforcement protrusion includes a thumb area such that the user's thumb may press on the thumb area when rotating the handle.

3 Claims, 5 Drawing Sheets

HANDLE OF A HAND TOOL

FIELD OF THE INVENTION

The present invention relates to a hand tool that has a handle with a wide surface to which the user's fingers are in contact therewith such that the user's fingers are comfortable during operating the hand tool.

BACKGROUND OF THE INVENTION

A conventional hand tool is disclosed in U.S. Pat. No. 6,257,101 and includes a handle and a head which includes a fixed jaw and a movable jaw. The handle is a flat handle and becomes gradually wider toward the remote end opposite to the head. The handle includes two sides which are narrow and perpendicular to the plane where the head lies. When using the hand tool, the user holds the handle with the four fingers excluding the thumb contacting the narrow sides, and rotates the handle to tighten or loosen an object that is clamped between the two jaws of the head. The direction of the rotation is perpendicular to the narrow sides so that the four fingers apply the force to rotate the hand tool at the narrow sides. This specific way of rotating the handle generates huge pressure to the portions of the fingers contacting the narrow sides. This makes the user feel painful of his or her fingers. Although the conventional handle is used for a long period of time, it is not satisfied by the users.

The present invention intends to provide a handle of a hand tool wherein the wide area of the handle is perpendicular to the direction of rotation and a reinforcement protrusion is provided to increase the structural strength of the handle.

SUMMARY OF THE INVENTION

The present invention relates to hand tool which comprises a driving end which is connected to a first end of a handle. The handle includes two opposite wide surfaces and two opposite narrow sides. The wide surfaces are perpendicular to a rotational direction of the handle so that the user's fingers except for the thumb may contact the wide surface.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
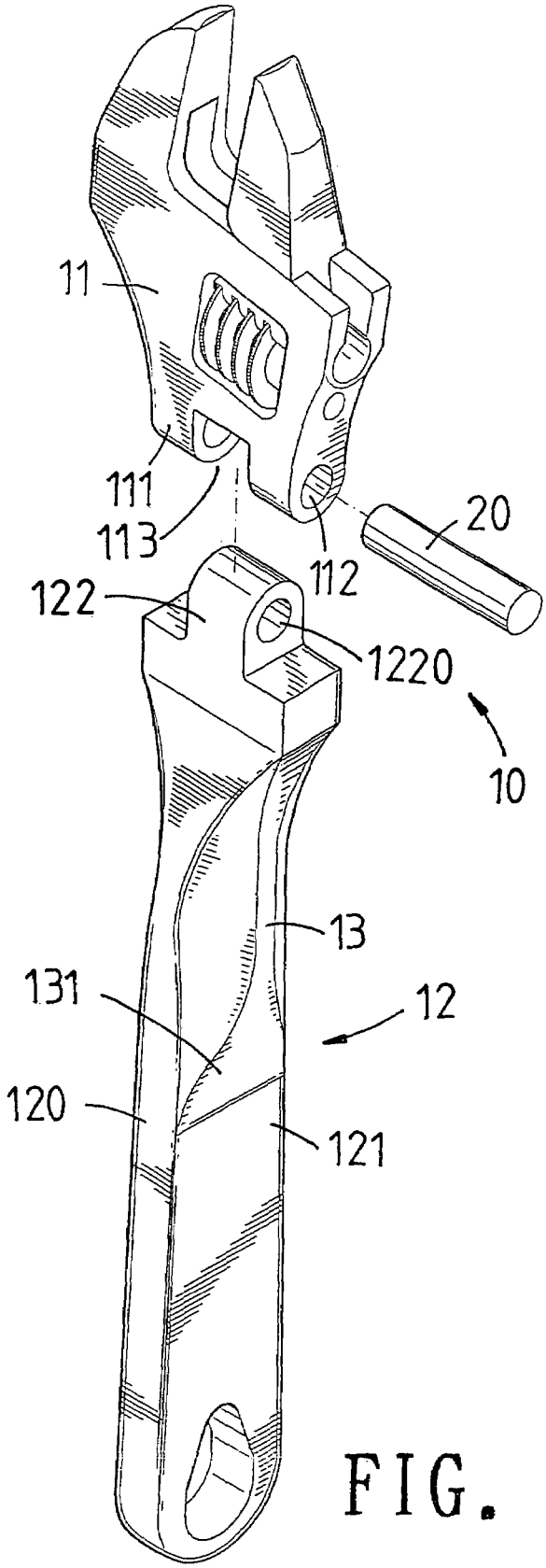
FIG. 1 is an exploded view to show the hand tool of the present invention.
Figure 2:
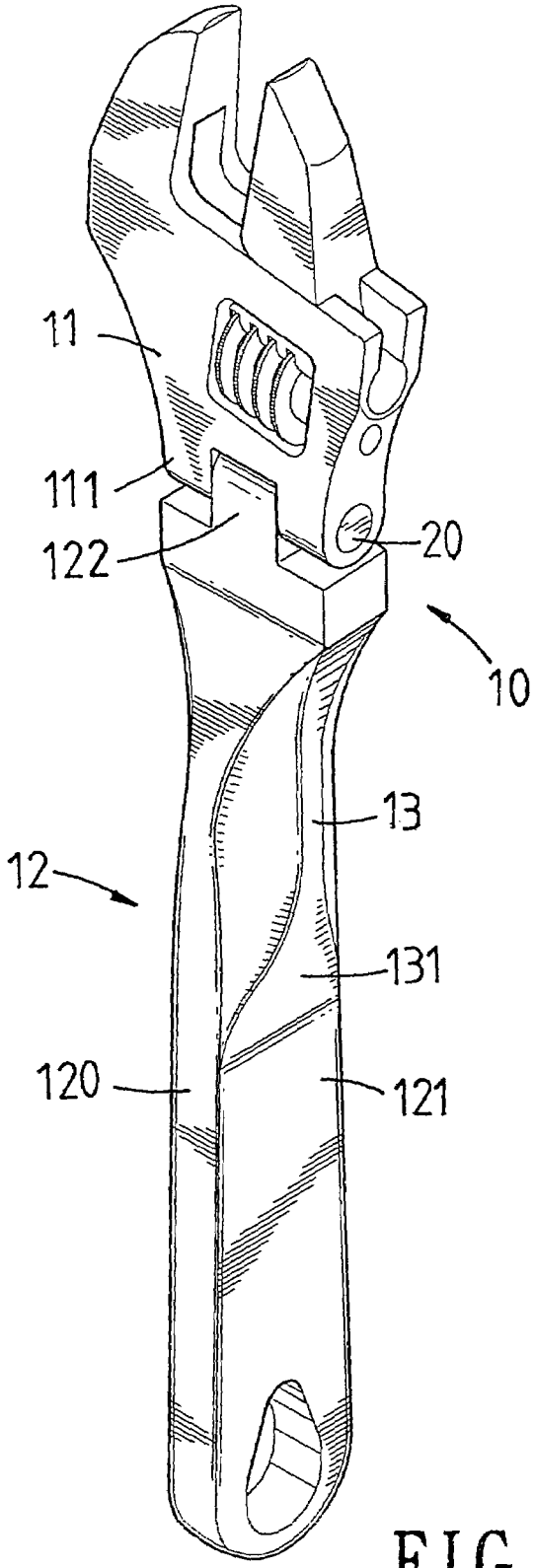
FIG. 2 is a perspective view to show the hand tool of the present invention.
Figure 3:
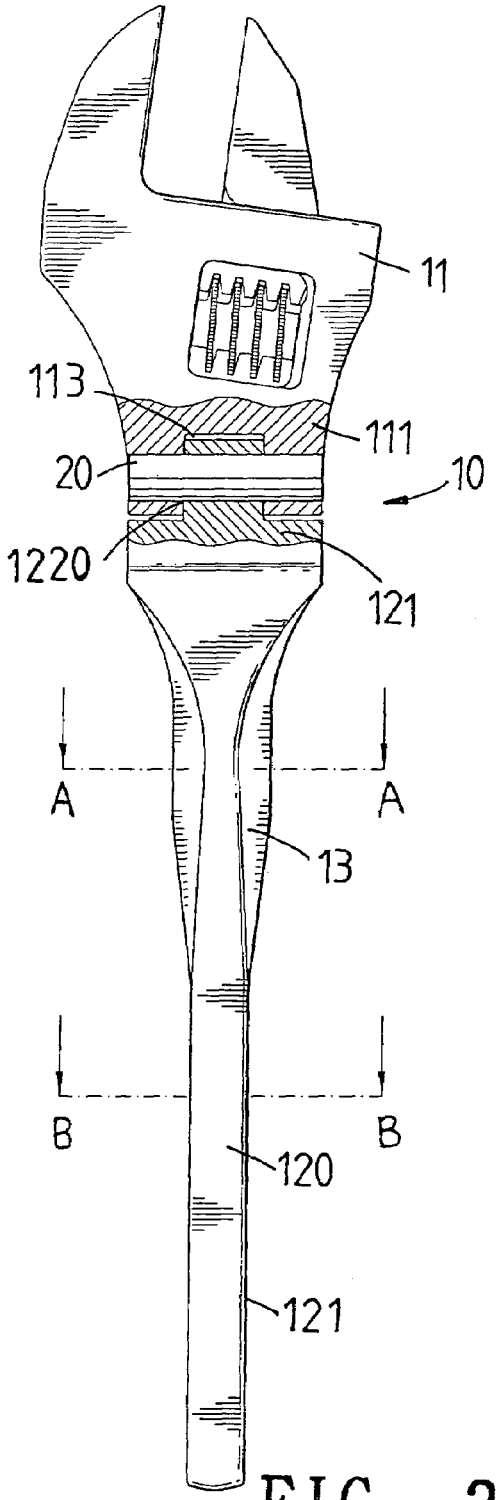
FIG. 3 is a side view, partly in section, of the hand tool of the present invention.

Referring to FIGS. 1 to 3, the hand tool 10 of the present invention comprises a driving end 11 which includes a fixed jaw and a movable jaw, and the driving end 11 includes two lugs 111 and each lug has a second hole 112 defined therethrough. A handle 12 has a first end connected to the driving end 11 and the first end of the handle 12 has an insertion 122 with a first hole 1220 defined therethrough. The insertion 122 is located in a space 113 between the two lugs 111 and pivotably connected between the two lugs 111 by extending a pin 20 through the second holes 112 in the lugs 111 and the first hole 1220 in the insertion 121. Therefore, the driving end 11 can be pivoted according to needs as shown in F*ig*. 6.

The handle 12 includes two opposite wide surfaces 121 and two opposite narrow sides 120. The wide surfaces 121 are perpendicular to a rotational direction of the handle 12, and the wide surfaces 121 are perpendicular to a plane where the driving end 11 lies on as shown in the drawings in this embodiment. A reinforcement protrusion 13 extends perpendicularly from each of the wide surfaces 121 and is located close to the first end of the handle 12. Each reinforcement protrusion 13 includes a thumb area 131 which is inclined to the wide surface 121 corresponding thereto.

Figure 4:
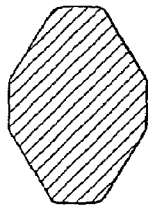
FIG. 4 shows a cross sectional view of the portion taken from line A—A in FIG. 3.
Figure 5:
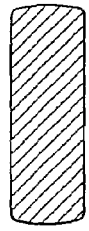
FIG. 5 shows a cross sectional view of the portion taken from line B—B in FIG. 3.
Figure 6:
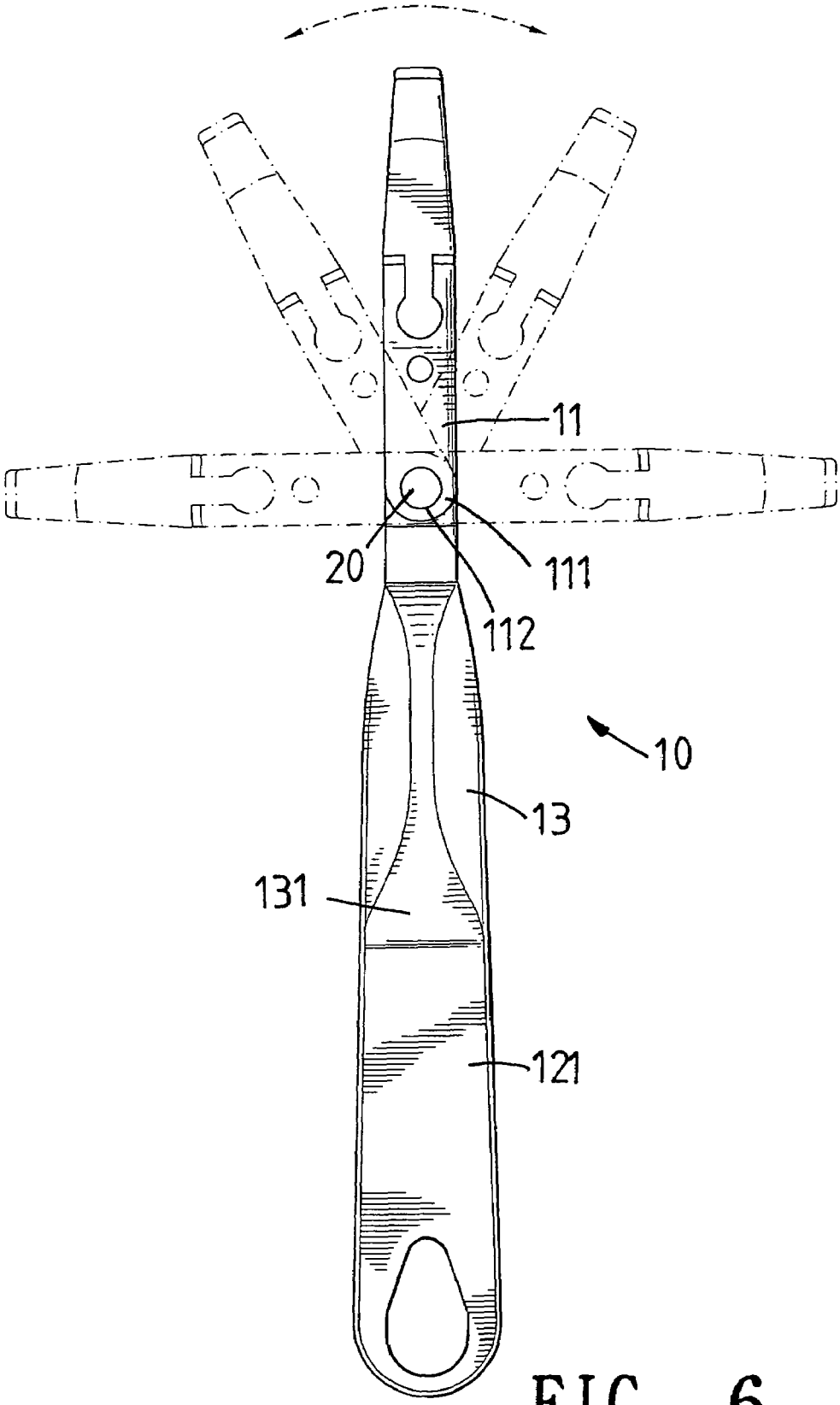
FIG. 6 shows the driving end of the hand tool can be pivoted.

As shown in FIGS. 4 and 5, each of the reinforcement protrusions 13 includes a flat ridge and two inclined sides connected to two sides of the flat ridge such that the handle 12 is reinforced in structural strength when output a torque. The cross section of the handle 12 not including the reinforcement protrusions 13 is a rectangular cross section.

Figure 7:
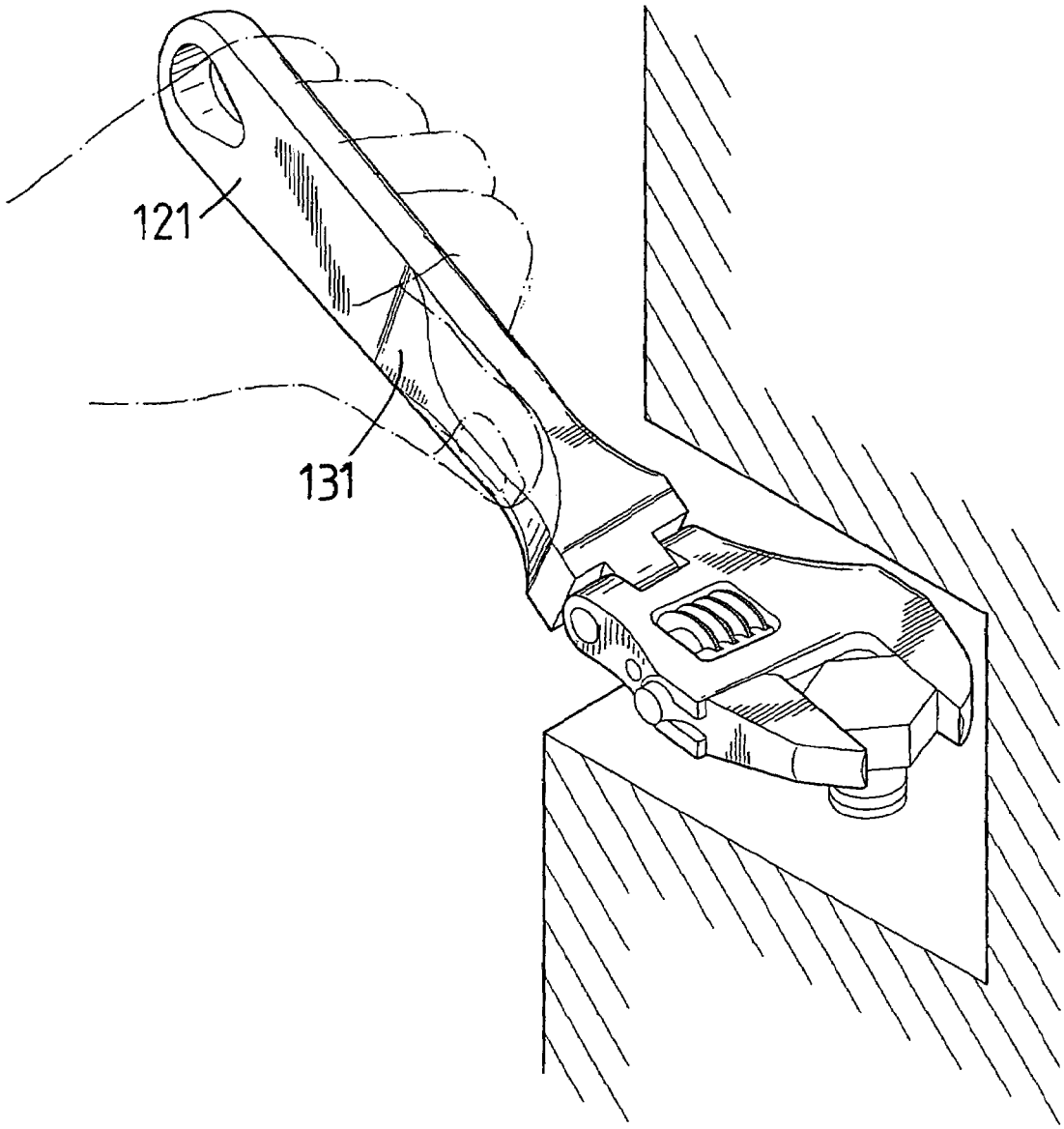
FIG. 7 shows that the user holds the handle to drive a screw head.

As shown in FIG. 7, when using the hand tool 10, the thumb presses on the thumb area 131 and the four fingers hold the wide surface 121 opposite to the thumb, the handle 12 is then rotated comfortably.

While we have shown and described the embodiment in accordance with the present invention, it should be clear to those skilled in the art that further embodiments may be made without departing from the scope of the present invention.

What is claimed is:

1. A hand tool comprising:

a driving end;

a handle having a first end to which the driving end is connected, the handle including two opposite wide surfaces and two opposite narrow sides, the wide surfaces being adapted to be perpendicular to a rotational direction of the handle, a reinforcement protrusion extending perpendicularly from each of the wide surfaces and located close to the first end of the handle, each reinforcement protrusion including a thumb area which is inclined to the wide surface corresponding thereto.

2. The hand tool as claimed in claim 1, wherein the wide surfaces are adapted to be perpendicular to a plane where the driving end lies on.

3. The hand tool as claimed in claim 1, wherein the first end of the handle has an insertion with a first hole defined therethrough, the insertion pivotably connected between two lugs on the driving end by extending a pin through two respective second holes in the two lugs and the first hole in the insertion.

* * * * *